United States Patent [19]

Burney, Jr. et al.

[11] Patent Number: 4,839,012

[45] Date of Patent: Jun. 13, 1989

[54] ANTISURGE OUTLET APPARATUS FOR USE IN ELECTROLYTIC CELLS

[75] Inventors: Harry S. Burney, Jr., Richwood, Tex.; Gregory J. E. Morris, Milan, Italy; Richard N. Beaver, Angleton; Robert D. Spradling, Lake Jackson, both of Tex.

[73] Assignee: The Dow Chemical Company, Midland, Mich.

[21] Appl. No.: 140,845

[22] Filed: Jan. 5, 1988

[51] Int. Cl.[4] ..... C25B 9/00; C25B 15/08

[52] U.S. Cl. ..... 204/255; 204/257; 204/263; 204/269; 204/275; 204/279

[58] Field of Search ..... 204/255–258, 204/263–266, 269–270, 279, 275

[56] References Cited

U.S. PATENT DOCUMENTS

| | | | |
|---|---|---|---|
| 3,312,614 | 4/1967 | Schick | 204/263 X |
| 3,679,568 | 7/1972 | Westerlund | 204/242 |
| 3,836,448 | 9/1974 | Bouy et al. | 204/270 |
| 3,855,091 | 12/1974 | Piester | 204/128 |
| 3,928,150 | 12/1975 | Rahn et al. | 204/98 |
| 3,928,165 | 12/1975 | Piester | 204/278 |
| 3,968,021 | 7/1976 | Rahn et al. | 204/256 |
| 3,988,235 | 10/1976 | Shibata et al. | 204/266 |
| 4,069,129 | 1/1978 | Sato et al. | 204/258 |
| 4,149,952 | 4/1979 | Sato et al. | 204/258 |
| 4,210,512 | 7/1980 | Lawrance et al. | 204/257 |
| 4,295,953 | 10/1981 | Fuseya et al. | 204/263 X |
| 4,322,281 | 3/1982 | Wright et al. | 204/263 X |
| 4,433,082 | 2/1984 | Grot | 524/755 |
| 4,465,579 | 8/1984 | Mataga et al. | 204/255 |
| 4,488,946 | 12/1984 | Morris et al. | 204/98 |
| 4,557,816 | 12/1985 | Yoshida et al. | 204/263 X |
| 4,560,452 | 12/1985 | Morris et al. | 204/98 |
| 4,568,434 | 2/1986 | Morris et al. | 204/98 |
| 4,571,288 | 2/1986 | Boulton | 204/98 |
| 4,581,114 | 4/1986 | Morris et al. | 204/267 |
| 4,602,984 | 7/1986 | Beaver et al. | 204/59 R |

FOREIGN PATENT DOCUMENTS

| | | |
|---|---|---|
| 58-31893 | 7/1983 | Japan . |
| 46191 | 10/1985 | Japan . |

*Primary Examiner*—Donald R. Valentine

[57] ABSTRACT

The invention is a dampening device for use in a vertically disposed electrochemical cell unit of the type at least having: (a) a peripheral flange which defines at least one electrode chamber, said peripheral flange having a upper, substantially horizontally disposed flange portion, a lower substantially horizontally disposed flange portion, and two disposed side flange portions; and (b) at least one outlet port passing through the upper horizontally disposed flange portion or through one of the two vertical side flange portions or through the lower flange portion and connecting the exterior of the cell with the electrode chamber. The dampening device is an elongated, hollow duct positioned across at least a portion of the top of the electrode chamber adjacent to the upper, horizontally disposed flange portion, said duct being in fluid flow communication with said electrode chamber and with said outlet port(s), wherein the duct has at least one opening near its top which connects the interior of the duct with the electrode chamber, wherein said opening(s) has a total cross sectional area less than or equal to the greatest internal cross sectional area of the duct.

The invention includes an electrochemical cell containing the dampening device.

59 Claims, 3 Drawing Sheets

SEC. A-A

ANTISURGE OUTLET APPARATUS FOR USE IN ELECTROLYTIC CELLS

This invention relates to a dampening device for use in electrochemical cells which is useful for the quick and efficient removal of gases and electrolytes from the interior portion of an electrochemical cell in a manner to minimize pressure fluctuations within the internal portions of the cell. In particular, the invention relates to the use of a specially designed duct in the upper portion of a electrode chamber of an electrochemical cell to efficiently remove gases and liquids from the electrode chamber while minimizing pressure fluctuations therein.

BACKGROUND OF THE INVENTION

Before the advent of ion exchange membranes and thin, catalytically active, dimensionally stable electrodes, most electrochemical cells were rather massive, as compared to the newer cells. Since they were rather massive, many day-to-day operational conditions (which still exist with the newer cells) did not cause problems within the cells. However, recently there has been a revolution in electrochemical cell design, primarily as the result of the use of ion exchange membranes, and catalytically active, dimensionally stable electrodes. These developments have allowed designers to minimize the distance between the electrodes to increase cell operating current densities and increase cell operating pressures, while at the same time conserving energy that would otherwise be wasted as a result of resistance losses caused by the passage of electrical current through the fluids filling the rather large space between the electrodes. Most modern cells have the electrodes pressed against, or at least, very close to, the ion exchange membrane. Such compact designs work very well and are very efficient. However, they are much more prone to operational problems, then were the older, more massive cells, because of the delicate nature of the ion exchange membranes and of the catalytically active, dimensionally stable electrodes. One problem encountered with the newer design of cells is the problem of pressure fluctuations inside the cell itself caused by the removal of gases and liquids from the interior portions of the cell.

Compact electrochemical cells have an anode and a cathode separated by an ion exchange membrane or diaphragm and are used commercially to electrolyze electrolyte solutions to produce a wide variety of chemicals. Many of such cells produce a gas/electrolyte mixture which must be removed from the cell for recycle or for further processing. For example, electrochemical cells with ion exchange membranes are used commercially to electrolyze an aqueous NaCl solution to form a mixture of hydrogen and a sodium hydroxide solution on the cathode side of the cell and a solution of chlorine and spent brine on the anode side of the cell.

If the gaseous product of electrolysis are not removed from the cell soon after they are produced, gas pockets build up within the cell and prevent electrolyte from contacting portons of the electrodes, leading to inefficient operation. This problem becomes more noticeable as current density and electrode area is increased. The absence of electrolyte at the electrode deactivates that portion of the electrode, and thus causes inefficient operation of the cell. The gas pockets also prevent electrolyte from contacting portions of the ion exchange membrane. The absence of electrolyte at that portion of the membrane, causes the membrane to suffer detrimental changes in its physical and chemical properties. These changes are irreversible and cause permanent damage to the membrane.

Another more serious problem is the creation of severe pressure fluctuations within the cell as a result of the improper removal of a gas/liquid mixture from the cell. The gases and liquids tend to separate in the interior of the cell body electrode chamber or in the outlet port and frequently result in the fluid slugging in the outlet line. As the slugs of liquid and gas flow through the outlet line, they cause severe pressure fluctuations in the line. These pressure fluctuations travel back through the liquid in the line and into the electrode chambers of the cell. Pressure fluctuations as high as about 100 centimeters of water have been measured inside the outlet ports and inside the electrode chambers of such cells. These pressure fluctuations cause the membrane to flex which, when coupled with the fact that a portion of the membrane may not be contacted with electrolyte, frequently causes the membrane to crack or break. An ion exchange membrane that is cracked or broken does not serve its intended function, i.e. to transport ions from one electrode chamber to the other electrode chamber, while remaining substantially hydraulically impermeable. It is not practical to patch cracks in the membrane during operation of the cell, nor is it economical to stop operation of the cell to replace the defective membrane.

The present invention provides a dampening device for use in electrochemical cells to remove gases and liquids from the interior portions of a cell while minimizing pressure fluctuations within the cell which result from slug flow and resulting pressure surges created by the improper removal of gases and liquids from the electrode chambers.

SUMMARY OF THE INVENTION

The invention is a dampening device for use in a vertically disposed electrochemical cell unit of the type at least having: (a) a peripheral flange which defines at least one electrode chamber, said peripheral flange having a upper, substantially horizontally disposed flange portion, a lower substantially horizontally disposed flange portion, and two disposed side flange portions; and (b) at least one outlet port passing through the upper horizontally disposed flange portion or through one of the two vertical side flange portions or through the lower flange portion and connecting the exterior of the cell with the electrode chamber. The dampening device is an elongated, hollow duct positioned across at least a porton of the top of the electrode chamber adjacent to the upper, horizontally disposed flange portion, said duct being in fluid flow communication with said electrode chamber and with said outlet port(s), wherein the duct has at least one opening near its top which connects the interior of the duct with the electrode chamber, wherein said opening(s) has a total cross sectional area less than or equal to the greatest internal cross sectional area of the duct.

The invention includes an electrochemical cell containing the dampening device.

BRIEF DESCRIPTION OF THE DRAWINGS

The invention can be better understood by reference to the drawings illustrating the preferred embodiment of the invention, and wherein like reference numerals refer to like parts in the different drawing figures and wherein.

DETAILED DESCRIPTION OF THE INVENTION

Figure 1:
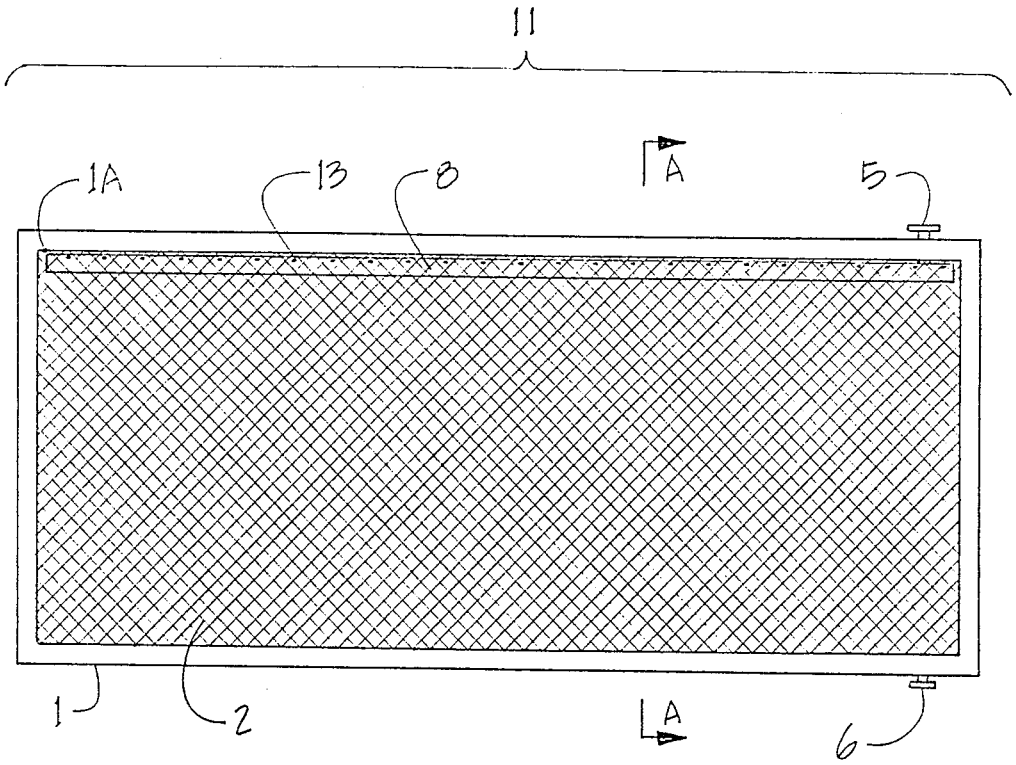
FIG. 1 is a plan view of an electrochemical cell unit including the dampening device of this invention shown with accompanying parts.
Figure 2:
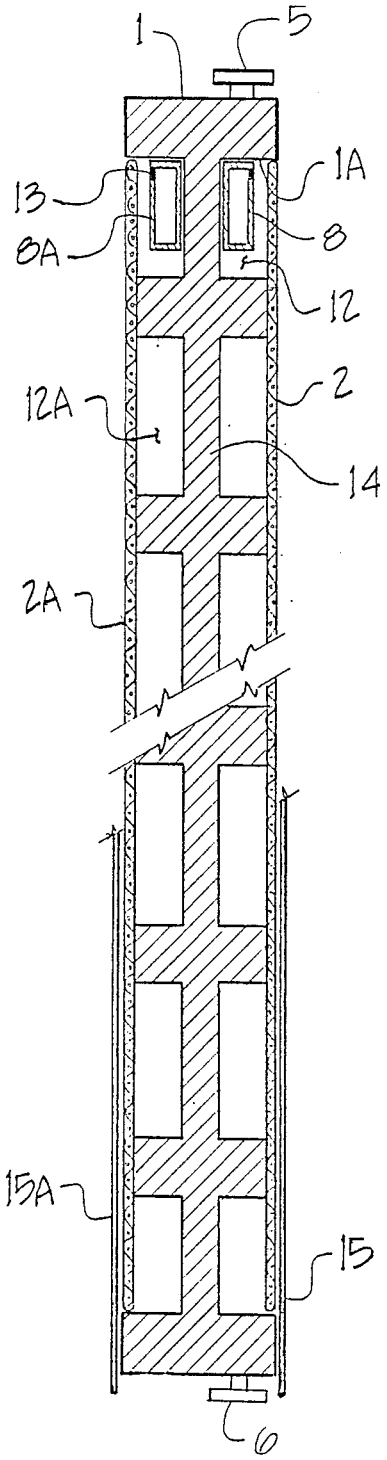
FIG. 2 is a partial cross-sectional side view of the cell unit shown in FIG. 1 as viewed along section line AA.

FIGS. 1 and 2 show a vertically disposed electrochemical cell unit 11 of the type having a peripheral flange 1 which, along with the planar backboard 14 and the ion exchange membranes 15 and 15*a*, define electrode chambers 12 and 12*a*. Electrodes 2 and 2*a* are housed within their respective electrode chambers 12 and 12*a*. Each electrode chamber 12 and 12*a* has at least one outlet port, for example, 5 passing through an upper, horizontally disposed flange portion 1B of peripheral flange 1 and connecting to the electrode chambers 12 or 12*a* of the cell unit 11.

Cell units in which the present invention is useful may have a generally rectangular shape (like the cell unit shown in FIGS. 1 and 2), although it is not critical that the cell unit be rectangularly shaped. Rather, the cell unit can be round, elliptical, oblong, or parabolic, or any other desired shape. However, such cell units are most desirably planar and have a planar backboard 14 which separates the cell unit into two electrode chambers 12 and 12*a*.

When electrochemical cell units of the type in which the present invention are usefyl are operated in a bipolar fashion, an anode is positioned on one side of the planar backboard 14, while a cathode is positioned on the other side of the planar backboard 14. A plurality of such cell units are placed adjacent to each other such that an anode of one cell unit faces a cathode of its adjacent cell unit. An ion exchange membrane 15 or 15*a* is placed between the adjoining anode and cathode. The area between the planar backboard 14 and the membrane 15 is, for example, the anode chamber and the area between the membrane 15*a* and the planar backboard 14 is, for example, the cathode chamber.

In a similar fashion, when the cell unit is operated in a monopolar fashion, either (1) an anode is positioned on each side of the planar backboard 14, or (2) a cathode is positioned on each side of the planar backboard 14, making each unit an anode unit or a cathode unit. In operation, an anode unit is placed adjacent to a cathode unit such that an anode of one unit faces a cathode of the adjoining unit. An ion exchange membrane 15 or 15*a* is placed between the adjoining anode of one unit and the cathode of another unit. In this case, the area between the membrane 15 or 15*a* and the planar backboard 14 is the anode chamber or the cathode chamber, as the case may be. Some monopolar cell units do not have planar backboards 14 because the same chemicals are on both sides of the planar backboard, if there were one.

The device of the present invention works equally well in cell units without planar backboards. In such a case, the dampening device 8, is positioned adjacent to the upper, horizontally disposed flange portion 1B. The dampening device 8 is of a size such that it occupies a substantial portion of the space between the electrodes and the planar backboard 14, or between the electrodes which are positioned on each side of the electrode chamber, if no planar backboard is present. By occupying a substantial portion of the space between the electrodes, the gas and electrolyte that is to be removed from the electrode chamber, must increase its flow velocity as it passes around the dampening device 8 and toward openings 13 in the dampening device 8. This design which causes an increase in the flow velocity of the gas/electrolyte mixture may help in preventing the gas bubbles from coalescing and forming a gas pocket within the electrode chamber.

The device of the present invention is thought to work for two major reasons. First, small bubbles naturally rise vertically but without the device of the present invention, the bubbles must migrate horizontally to the gas/electolyte outlet port. In moving transversely, the bubbles strike or collide with vertically rising bubbles. The collision results in a larger bubble. Larger bubbles rise even faster so that they reach the top of the cell before they reach the port 5. By simply dividing the port 5 into numerous ports through the use of the device of the present invention, all bubbles can rise vertically to minimize transverse flow, thus reducing the overall size of the bubbles, and reducing the formation of gas pockets in the cell. Second, the inclusion of the device of the present invention provides a practical means to allow the combining tiny gas bubbles from affecting the electrolysis area. The tiny bubbles are removed from the actual cell area and then are allowed to combine. The device of the present invention also serves as a conduit to channel the products to the outlet port 5 of the cell.

Regardless of whether the cell unit 11 is operated in a bipolar or a monopolar fashion, the area between the membrane 15 or 15*a* and the planar backboard 14 is hereinafter called the electrode chamber, represented in FIG. 2 as items 12 and 12*a*.

Electrochemical cell units of the type in which the present invention is particularly useful are, for example, those described in U.S. Pat. Nos. 4,488,946; 4,568,434; 4,560,452; 4,581,114; and 4,602,984. Those patents are hereby incorporated by reference for the purposes of the electrochemical cell units they teach.

For the sake of convenience in describing the present invention, it will be discussed with respect to only one electrode chamber. However, the dampening device may be placed in either, or both, of the electrode chambers or in the case of a cell having no planar backboard, in the chamber between the two electrodes.

Dampening device 8 is in fluid flow communication with both the electrode chamber 12 and the outlet port 5. Dampening device 8 is positioned in the electrode chamber 12 adjacent to an upper, internal edge 1A of the upper, horizontally disposed peripheral flange portion 1B. The dampening device 8 preferably, although not necessarily, has an upper surface shape approximately corresponding to the shape of the upper, internal edge 1A of the upper, horizontally disposed peripheral flange portion 1B.

Dampening device 8 has at least one opening 13 which opens near the top of the dampening device 8 and connects the interior of the dampening device 8 with the electrode chamber 12. The sum of the cross-sectional area of the openings 13 at the top of the device 8 are preferably equal to or less than the cross-sectional area of the outlet port(s). Also, the cross-sectional area of the dampening device is preferably equal to or greater than the cross-sectional area of the outlet port(s). If these general relationships are not followed, the gas bubbles tend to combine and form large gas bubbles inside the cell.

Preferably, the ends of the dampening device 8 are closed, however, the dampening device 8 operates reasonably well even when its ends are open. This is especially true when the end of the dampening device 8 farthest away from the outlet port 5 is open.

Preferably, the dampening device 8 is sized and positioned in a manner to provide for a space between the dampening device 8 and its adjoining electrode 2. During operation of the cell unit 11, the space between the dampening device and the electrode 2 is filled with electrolyte and gas, thus making full use of the electrode surface within the cell unit 11.

The gaseous and liquid contents of the electrode chamber 12 during operation depends on the type of cell unit under consideration. For example, in a chlor-alkali electrolytic cell unit, an anode electrode chamber 12 would contain a sodium chloride brine solution and chlorine, while a cathode electrode chamber 12A would contain an aqueous sodium hydroxide solution and hydrogen.

The dampening device 8 is preferably substantially hollow, but may be at least partially filled with, for example, a packing material. In addition, the dampening device 8 may have in its interior, channels, vanes, or other flow direction controlling devices.

The dampening device 8 may be constructed from any material which is at least somewhat resistant to the conditions within the electrode chamber. For example, in a chlor-alkali cell unit, the dampening device 8 may conveniently be constructed from, for example, iron, steel, stainless steel, nickel, lead, molybdenum, cobalt, valve metals, and alloys containing a major portion of these metals. In the case of chlor-alkali cell units, nickel is preferred for use in the catholyte chamber because of its chemical stability in alkaline service.

For the anolyte chamber, the dampening device 8 may conveniently be constructed from, for example, titanium, tantalum, zirconium, tungsten, other valve metals not materially affected by the anolyte, and alloys containing a major portion of these metals. In addition, the dampening device 8 may be constructed from various plastic materials including Teflon TM polytetrafluoroethylene and Kynar TM plastic. In the case of chlor-alkali cell units, titanium is preferred for use in the anolyte chamber because of its chemical stability in wet chlorine and brine service.

The dampening device 8 may physically contact the upper, substantially horizontally disposed peripheral flange 1B, or merely be near the peripheral flange 1B. As a general rule, the dampening device preferably contacts the inner surface 1A of the upper, substantially horizontally disposed peripheral flange 1B or be within about 2.5 centimeters of the surface 1A. Optionally, the walls of the dampening device 8 can be at least partially defined by the peripheral flange 1 and/or the planar backboard. In other words, the upper portion of the dampening device 8 can be the inner surface 1A of the upper, substantially horizontally disposed peripheral flange 1B.

The dampening device 8 preferably extends across the top of the electrode chamber over at least 50 percent of the distance of the electrode chamber. Particularly preferred, however, is a dampening device 8 that extends throughout substantially the entire length of the top portion of the electrode chamber 12, as shown in FIG. 1. The damening device 8 can assume almost any shape including round, oval, or rectangular.

The dampening device 8 may be slanted toward the outlet port(s) 5 or positioned in a substantially horizontal position. Preferably, however, the dampening device 8 is not slanted away from the outlet port(s) 5. Such a slant would result in electrolyte at least partially blocking the dampening device 8 and would not allow easy, slug-free removal of the gas and electrolyte from the dampening device 8. In addition, such a slant would not allow gas and electrolyte to enter through all the opening(s) 13 in the dampening device 8, since some of them would be blocked by electrolyte. Most preferably, the dampening device 8 is substantially horizontally positioned.

The dampening device 8 of the present invention must have at least one opening 13 near its top to connect the interior of the dampening device 8 with the electrode chamber 12. The opening 13 may be a single slit, or a plurality of slits. Likewise, the opening 13 may be one or more holes which may be a variety of shapes. A particularly convenient and workable opening 13 is a plurality of holes located throughout substantially the entire length of the dampening device 8. Optionally, the dampening device may be constructed from porous metal particles bonded or sintered together.

The cross-sectional area and the number of openings 13 in the dampening device 8 is dependent upon the physical properties and the quantity of gas and electrolyte that will be flowing through the dampening device 8 to the outlet port 5 during cell operation and on cell pressure, current density and the recycle rate of fluids through the cell. However, as a general rule, the opening(s) 13 should be sized to provide for a velocity of the gas and electrolyte through the opening(s) 13 which is greater than the flow velocity through the outlet port(s). For example, in a cell where the flow velocity from the bottom of the cell to the top of the cell has a liquid flow velocity of about 0.025 feet per second (ft./sec.), the openings should be sized to cause a fluid flow velocity of greater than about 2.5 ft./sec.. As a general rule, the cross-sectional area of the openings are from about 0.2 square millimeters to about 200 square millimeters. More preferably, the openings have a cross-sectional area of from about 3 square millimeters to about 50 square millimeters. Most preferably, the openings have a cross-sectional area of from about 7 square millimeters to about 20 square millimeters.

The velocity of the gas and electrolyte as they pass through dampening device 8 toward outlet port(s) 5 is not critical to the successful operation of the invention so long as the resistance is not so great as to substantially inhibit the flow of gas and electrolyte to the outlet port(s) 5. The velocity is preferably equal to or less than the flow velocity in the outlet port 5.

A particularly preferred embodiment for the type and design of openings in the dampening device 8 has been found to be a plurality of spaced-apart openings near the top of the dampening device 8 which are located throughout substantially the entire length of the dampening device 8.

When a plurality of holes are used as the opening 13, the spacing between the holes has not been found to be particularly critical. However, in certain large size cells, it has been found that optimally more holes are positioned at the end of the dampening device furthermost from the outlet port 5 to minimize pressure fluctuations. It is sometimes desirable to have the holes spaced unevenly because the rate of production of a gaseous product within an electrochemical is constant along the length of the cell and the gas produced tends to flow directly upward; however, the driving force for flow through one of these holes (cell pressure near the hole minus pressure inside the dampening device near the hole) is less at the furthermost end of the cell than at the other end (nearer the outlet nozzle) because the pressure inside the dampening device is higher at the furthermost end of the cell. Since the driving force for flow for a single hole is less at the furthermost end of the dampening device and since all the holes are identical, there will be less flow through each hole at the furthermost end of the dampening device. By making the holes more numerous at the furthermost end of the dampening device (farthest from the outlet nozzle), the total flow into the dampening device for a given length of cell is increased. The total flow into a given length of the dampening device must be adequate so that all the gaseous product produced along any portion of the length of the cell (corresponding to this given length of dampening device) will flow through the holes into the dampening device. If all the gaseous product produced in this length of cell (corresponding to the given length of dampening device) does not flow through the holes into the dampening device, then this gas is likely to flow vertically to the top of the electrode compartment and then horizontally along the top of the electrode compartment but outside the dampening device. This horizontal flow of gas across the top of the electrolyte compartment may cause gas pockets to form that are in contact with the membrane (thereby effectively inactivating sections of the membrane for ionic conduction) and the electrode (thereby effectively inactivating sections of the electrode for electrolytic reaction). This horizontal flow of gas along the top of the cell may also produce wave action near the top of the electrode chamber 12 which may cause pressure fluctuations inside the electrode chamber 12.

Moving along the dampening device toward the outlet nozzle, the horizontal flow through the dampening device increases as the flow through each hole adds to this horizontal flow. Since the dampening device preferably has a constant cross-sectional area, the flow velocity is also increasing as the horizontal flow is increasing. This increase in velocity causes a corresponding decrease in pressure inside the dampening device. There is also a frictional pressure drop caused by this horizontal flow. Therefore, pressure inside the dampening device is decreasing along its length toward the outlet nozzle. This causes the driving force for flow through each hole to be greater nearer the outlet nozzle since the cell chamber pressure is approximately constant, but the dampening device pressure decreases. Therefore, the flow through each hole is greater so fewer holes are needed near the outlet port end of the dampening device.

Although the theory of operation of the dampening device 8 is not totally understood, it has been discovered that it performs surprisingly well to reduce the pressure fluctuations in the electrode chamber 12. It is thought that the dampening device 8 acts as a type of damper; dampening the pressure fluctuations in the dampening device 8 that are caused by the gas/electrolyte mixture leaving outlet ports 5 and 5*a* from affecting the pressure in the electrode chamber 12. In addition, the presence of the dampening device 8 in the electrode chamber 12 minimizes the volume of gas and electrolyte in the area between the dampening device 8 and the electrode 2. This causes the gas/electrolyte mixture to have a superficial velocity substantially greater than the superficial velocity of the gas/electrolyte mixture in the remaining portions of the electrode chamber 12. The increased superficial velocity of the gas/electrolyte mixture minimizes the separation of the gas from the electrolyte and may help in keeping the gas bubbles dispersed in the electrolyte. Since the gas and electrolyte do not separate within the electrode chamber 12, but separate within the dampening device 8, the formation of slugs within the electrode chamber 12 is minimized.

In the operation of a cell unit 11 employing the present invention, unreacted electrolyte is introduced into the cell unit through one or more inlet port 6. This port is usually located in the bottom of the electrode chamber 2. Electrical current is passed through the electrolyte causing electrolysis to occur. Electrolysis produces a variety of products, depending upon the type of cell unit. The present invention is useful in those cell units in which a gas is produced and in which a gas/electrolyte mixture is removed from the cell unit. The gas that is produced in the cell unit mixes with the electrolyte to form a mixture. The gas has a density less than the electrolyte and rises to the top of the cell unit. As the gas rises, it carries electrolyte with it. As the mixture rises, it encounters an area adjacent to the dampening device 8 where the fluid flow velocity is greater than the velocity in the remaining portions of the electrode chamber 12. At this point, the gas/electrolyte mixture passes around the lower portion of the dampening device 8 and toward the openings 13 in the upper portion of the dampening device 8. The flow velocity of the mixture increases because there is not as much volume in this portion of the cell unit because most of the volume is occupied with the dampening device 8. The mixture then passes through the opening(s) 13 in the upper portion of the dampening device 8. When the gas/electrolyte mixture enters the opening(s) 13, the flow velocity of the mixture is increased again as it passes through the openings 13.

After entering the dampening device 8, the gas and electrolyte usually separate within the inner portion of the dampening device 8, forming an electrolyte-rich stream in the bottom of the dampening device 8 and a gas-rich stream in the upper part of the dampening device 8. The electrolyte and gas then flow toward the outlet port(s) 5. When the gas and electrolyte exit through the outlet port(s), they are transferred to a collection area. Since the gas and electrolyte separate in the dampening device 8, slug flow may occur at this point. The slug flow causes pressure fluctuations to occur, which are transferred throughout the dampening device 8. The pressure surges and fluctuations thus created are evenly distributed in the dampening device and are not sufficient to overcome the pressure exerted by the gas and the electrolyte as they pass through the openings 13 into the dampening device 8 from the electrode chamber 12. Thus, the formation of slugs in the electrode chamber 12 is significantly minimized.

If electrochemical cells are operated under pressure, slugging seems to be an even more severe problem. Therefore the present invention is particularly useful in a pressure cell.

Pressure variations along the dampening device cause changes in flow rates into the openings 13. The changes in pressure inside the dampening device are translated into changes in flow rate through the openings 13. Thus, the pressure changes inside the dampening device are not translated into pressure changes outside the dampening device in the electrode chamber. As a pressure wave travels down the dampening device, at the high pressure part of the wave (near the weak peak), flow rates into the openings 13 are decreased. At the low pressure part of the wave (near the wave trough), the flow rates into the openings 13 are increased. The total flow into the dampening device (through all the openings 13) is almost constant with time but the flow through each hole is continuously varying with time. The time-average flow through openings 13 near the outlet port 5 is much greater than the time-average flow through openings 13 which are far from the outlet port 5. For a properly working dampening device, this variation in time-average flow from hole-to-hole is preferably mostly a variation in liquid flow. If the dampening device has a uniform lateral hole spacing, all the variation in flow fro hole-to-hole must be a variation in liquid flow or horizontal gas flow inside the electrode chamber will result.

These openings 13 near the outlet with the much greater time-average flow rates also have a much greater variation in flow rate with time because the variation in pressure inside the device is much greater near the outlet port 5. So, these liquid flow rates are highest just at the point where they are needed to be highest, in order to adsorb pressure changes by changing flow.

There are two sources of disturbance in this system which cause the pressure variation in the dampening device: First, the horizontal two-phase flow across the dampening device develops into slug flow as the flow increases along the dampening device near the outlet. This slug flow can cause pressure variations. Second, the vertical two-phase flow in the port 5 is also slug flow and this slug flow causes even greater pressure variations. These two sources of disturbance interact in a complex manner to produce the variation in pressure in space and in time inside the dampening device. But since both of these disturbances originate near the outlet of the cell, then the variation in pressure tends to be highest near the cell outlet port 5. However, near the cell outlet port 5, the time-average pressure in the dampening device is the lowest. Therefore, with the device of the present invention, it is possible to maintain a constant pressure outside the dampening device in the electrode chamber, while the pressure inside the dampening device is varying.

Near the outlet, where the pressure variations inside the dampening device are great, a large variation in flow through the openings 13 is required to avoid changing the pressure outside the dampening device in the electrode chamber. Also, in this system, this is the point where the time-average flows through the openings 13 will be highest since the average pressure in the dampening device is lowest. So, with a constant pressure outside the dampening device in the electrode chamber, the driving force for flow in the dampening device is highest here.

The energy of the pressure pulse is dissipated by changing the flows through the openings 13. Some of the potential energy of the pulse is used up in slowing the flow through the openings 13 (high pressure part of the pressure wave) or increasing the flow through the openings 13 (low pressure part of the pressure wave).

Figure 3:
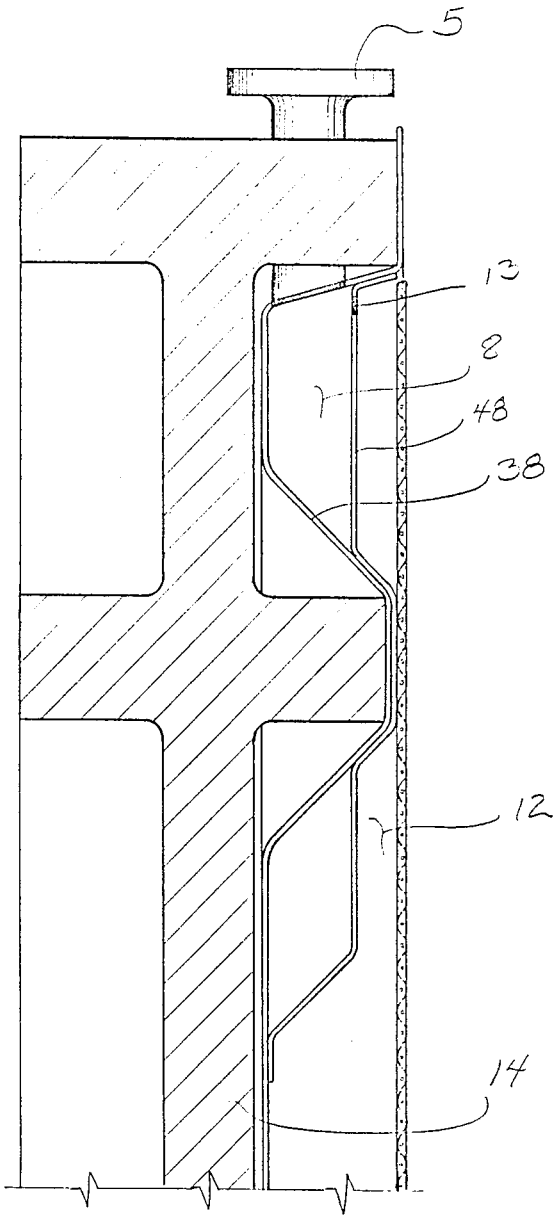
FIG. 3 shows an optional embodiment of the dampening device of this invention.

FIG. 3 shows an optional embodiment of the invention. It shows a dampening device 8 defined by a plates 38 and 48. Plate 48 also serves as a pan or liner protecting the backboard 14 from electrolyte present in the electrode chamber 12. The figure also shows outlet port 5, opening 13, and electrode 2.

EXAMPLE 1

This describes the electrolytic cell used in the Examples and an example of the invention using the dampening device.

The process according to the invention is carried out in a bipolar electrolytic cell similar to the one depicted in FIG. 1. A cation exchange membrane having a support scrim is used. The anode and the cathode are made of expanded metal and are coated with catalytically active coatings.

The anode and the cathode are approximately 5 ft. (1.52 meters) long and 12 ft. (3.66 meters) wide and are arranged vertical and parallel to one another at a distance of approximately 5 mm. The anode compartment is isolated from the planar backboard by a first pan. The first pan is welded to the planar backboard at a plurality of places. The expanded metal anode is welded atop the first pan at those same places. An anode chamber with a width of $\frac{5}{8}$" (16 millimeters) from the back side of the anode to the top side of the first pan is thus formed.

The cathode compartment is isolated from the planar backboard by a second pan. The second pan is welded to the planar backboard at a plurality of places. The expanded metal cathode is welded atop the second pan at those same places. A cathode chamber with a width of $\frac{5}{8}$" (16 millimeters) from the back side of the cathode to the top of the second pan is thus formed. A plurality of raised portions in the planar backboard provides the electrical connection between the anode and cathode of the bipolar unit.

Since the first pan and the second pan are not flat, but are conformed to fit the plurality of raised portions on the planar backboard, the width of the anode chamber and cathode chamber varies in the area near the plurality of raised portions on the planar backboard.

At the edges of the cell, the thickness of the peripheral flange is greatest. This thicker area of the flange extends around the perimeter of the cell and forms the outside boundary of the anode chamber and the cathode chamber. The first pan is fitted over this backboard area and extends outside the limits of the planar backboard casting, thus completing the isolation of the anode compartment from the planar backboard. The second pan is fitted over the other side of this backboard area and also extends outside the limits of the casting and completes the isolation of the cathode chamber from the planar backboard casting.

A first inlet nozzle is fitted into an opening at the top of the planar backboard at the corner opposite where the second inlet nozzle is inserted. This first inlet nozzle is fitted into an opening in the first pan at this point and it is seam welded to the first pan, thus forming an inlet for the anolyte and maintaining the isolation of the planar backboard from the electrolyte.

A second inlet nozzle is fitted into an opening at the bottom of the planar backboard near one corner. This second nozzle is fitted to an opening in the second pan at this point and it is welded to the second pan, thus forming an inlet for the catholyte and maintaining the isolation of the planar backboard from the electrolyte.

A first dampening device is installed in the top of the anode chamber above the top row of a plurality of raised portions on the planar backboard. The cross section of the dampening device is roughly rectangular in shape and has dimensions of 15/32 inch×1¾ inches (11.9 millimeters×44.5 millimeters). At the top of the first dampening device at the side nearest the titanium anode pan, the first dampening device is curved to fit the contour of the top of the titanium anode pan. The first dampening device is spot welded to the first pan so the back and top of the first dampening device is flush with the top of the first pan. This leaves a clearance of ⅛ inch (3.2 millimeters) between the front of the first dampening device and the back of the anode. The first dampening device has a length of 139¼ inches (3.53 Meters) and extends nearly the entire length of the anode chamber, 140¾ inches (3.57 meters). The first dampening device has 5/32 inch (4 millimeters) diameter holes drilled at the top of the first dampening device on the side facing the anode. There are 48 of these holes spaced varying distances apart along the first dampening device. This pluraity of holes acts as the inlet to the first dampening device.

A first dampening device outlet nozzle is fitted into an opening at the top of the planar backboard casting near one corner (the corner diagonally opposite to the corner near the anolyte inlet nozzle). This nozzle is fitted to an opening in the first pan at this point and it is seam welded to the first pan, thus forming an outlet for the anolyte liquid and anode side gaseous product and maintaining the isolation of the ductile iron cell casting from the anode chamber. All the flow out of the cell (gas and liquid) is conducted from the anode chamber into the plurality of holes in the first dampening device inlet, into the first dampening device, and horizontally along the first dampening device to the first dampening device outlet. There the two-phase flow enters the outlet nozzle and is conducted into the outlet tube.

The holes in the first dampening device are distributed unevenly across the length of the first dampening device. The holes are placed closer together (and are thus more numerous) near the end of the first dampening device farthest away from the outlet nozzle.

A second dampening device is installed in the top of the cathode chamber above the top row of plurality of raised portions on the planar backboard. The cross section of the second dampening device is roughly rectangular in shape and has dimensions of 15/32 inch×1¾ inches (11.9 millimeters×44.5 millimeters). The top of the second dampening device at the side nearest the second pan is curved to fit the contour of the top of the second pan. The second dampening device is spot welded to the second pan so the back and top of the second dampening device is flush with the top of the second pan. This leaves a clearance of ⅛ inch (3.2 millimeters) between the front of the second dampening device and the back of the cathode. The second dampening device has a length of 139¼ inches (3.53 meters) and extends 140¾ inches (3.57 meters), nearly the entire length of the cathode chamber. The second dampening device has a plurality of 5/32 inch (4 millimeters) diameter holes drilled at the top of the second dampening device on the side facing the cathode. There are 48 of these holes spaced varying distances apart along the second dampening device. These plurality of holes act as the inlet to the second dampening device.

A second dampening device outlet nozzle is fitted into an opening at the top of the planar backboard near one corner (the corner diagonally opposite to the corner near the second inlet nozzle). This nozzle is fitted to an opening in the second pan at this point and it is seam welded to the second pan thus forming an outlet for the catholyte liquid and cathode side gaseous product and maintaining the isolation of the planar backboard from the cathode chamber. This prevents flow from leaving the cathode chamber and going directly into the outlet nozzle. All the flow out of the cell (gas and liquid) is conducted from the cathode chamber into the plurality of holes in the second dampening device inlet, into the second dampening device, and horizontally along the second dampening device to the second dampening device outlet.

There the two-phase flow enters the second dampening device outlet nozzle and is conducted into a outlet tube.

The holes in the second dampening device are distributed unevenly across the length of the second dampening device. The holes are placed closer together (and are thus more numerous) near the end of the second dampening device farthest away from the outlet nozzle.

Four cells of the type just described are positioned adjacent to each other and held together connected in series. In order to maintain a distance of about 5 mm between the anode and cathode, and to hinder a discharge of electrolyte due to leakage, a gasket is placed on the flange section of the second pan. A anode terminal electrolytic cell which consists only of the anode chamber is found at one end of the series of electrolytic cells connected in series. On the other end of the series is a cathode terminal electrolytic cell which consists only of the cathode chamber. All electrolytic cells are arranged on a filter press stand and form the total bipolar electrolytic series.

The anolyte is pumped from a tank through the tube side of a shell and tube heat exchanger where steam is used on the shell side to heat the anolyte to approximately 90° C. The same is done for the catholyte.

An electrolysis is carried out with the use of the bipolar electrolyzer in which aqueous sodium chloride solution serves as anolyte and aqueous sodium hydroxide solution as catholyte. On the 14th day of operation of the aforesaid electrolyzer in each of the cell units the catholyte is fed at a rate of about 9.3 gallons per unit [35.2 liters per minute]. In each of the cell units, the anolyte is fed at a rate of about 7.7 gallons per minute [29.1 liters per minute]. Ion exchange treated NaCl brine (about 299 grams/liter NaCl, 1.4 grams per liter $Na_2CO_3$, and about 0.2 grams per liter NaOH) is added to the inlet anolyte line so that a concentration of about 200 grams per liter NaCl is reached at the discharge of the anode chamber for the sodium chloride solution. Water is added to the inlet catholyte line so that a sodium hydroxide concentration of about 32 weight % is obtained at the discharge of the cathode chamber. An electrolysis temperature of about 90° C. is obtained in the cathode and in the anode chambers by using heat exchangers.

Chlorine is formed at the anode and hydrogen at the cathode. There is an automatic pressure control valve at the top of the anolyte tank where the gaseous chlorine product is removed from the system. The chlorine pressure in the anolyte tank is measured using a pressure meter. This automatic valve is used to set the chlorine pressure in the anolyte tank at 15.2 psig (1.07 kilograms per square centimeter). The pressure difference between the cathode and the anode chambers is regulated by the adjustment of the corresponding pressure in the catholyte tank where the pressure difference between the catholyte tank and the anolyte tank is measured with a differential pressure meter. This differential between the catholyte tank and the anolyte tank is maintained at 11 inches $H_2O$ differential pressure (more in the cathode chamber) using an automatic differential pressure control valve at the top of the catholyte tank where the gaseous hydrogen product is removed from the system. The pressure in the catholyte tank is measured using a pressure meter and is 15.2 psig (1.07 kilograms per square centimeter).

The superficial flow velocity near the top of the cathode chamber is about 0.025 ft/sec. (0.46 meters per minute) for the liquid phase, for the gas phase it is about 0.068 ft/sec. (1.24 meters per minute). Actual velocities in the catholyte chamber may be different from this because the flow inside this chamber is complex and involves internal recirculation of electrolyte. The superficial flow velocity through the area between the front of the two-phase dampening device and the membrane is about 0.064 ft/sec. (1.17 meters per minute) for the liquid phase and for the gas phase it is about 0.17 ft/sec. (3.1 meters per minute). The flow velocity through the 48 holes in the two-phase dampening device probably varies for each hole because flows through each hole are probably different. For a hole that conducts the average flow (1/48 of the liquid flow from the cell and 1/48 of the gas flow from the cell), the superficial liquid velocity is 3.1 ft./sec. (56.7 meters per minute). The superficial gas velocity is 8.3 ft/sec. (152 meters per minute). The flow velocity inside the two-phase dampening device varies across the length of the dampening device because the flow through the dampening device increases as the flow through each hole adds to it. The maximum velocity of flow through the dampening device would correspond to the total liquid and gas flow out of the cell. The superficial liquid velocity corresponding to this total flow is 3.9 ft./sec. (71.3 meters per minute). The superficial gas velocity corresponding to this total flow is about 10.5 ft./sec. (192 meters per minute).

The superficial flow velocity near the top of the anode chamber is about 0.027 ft/sec. (0.49 meters per minute) for the liquid phase, for the gas phase it is about 0.10 ft/sec. (1.8 meters per minute). Actual velocities in the anolyte chamber may be different from this because the flow inside this chamber is complex and involves internal recirculation of electrolyte. The superficial flow velocity through the area between the front of the two-phase dampening device and the membrane is about 0.14 ft/sec. (2.6 meters per minute) for the liquid phase and for the gas phase it is about 0.53 ft/sec. (9.7 meters per minute). The flow velocity through the 48 holes in the two-phase dampening device probably varies for each hole because flows through each hole are probably different. For a hole that conducts the average flow (1/48 of the liquid flow from the cell and 1/48 of the gas flow from the cell), the superficial liquid velocity is 2.6 ft/sec. (47.5 meters per minute) and the superficial gas velocity is 9.9 ft/sec. (181 meters per minute). The flow velocity inside the two-phase dampening device varies across the length of the dampening device because the flow through the dampening device increases as the flow through each hole adds to it. The maximum velocity of flow through the dampening device would correspond to the total liquid and gas flow out of the cell. The superficial liquid velocity corresponding to this total flow is 3.3 ft./sec. (60.4 meters per minute). The superficial gas velocity corresponding to this total flow is 12.6 ft./sec. (230 meters per minute).

A pressure tap is located at the top corner of the catholyte compartment of cell #2 (near the catholyte outlet). A pressure transmitter measures the cell pressure at this point. A digital oscilloscope is used to analyze this pressure signal. Results are: average amplitude of pressure fluctuation −12.0 in. $H_2O$ and average frequency of pressure fluctuation −0.59 Hertz.

A pressure tap is located at the top corner of the anolyte compartment of the third cell in the series near the anolyte outlet. A pressure transmitter measures the cell pressure at this point. A digital oscilloscope is used to analyze the pressure signal. Results are: Average amplitude of pressure fluctuation −11.5 in. $H_2O$ and average frequency of pressure fluctuation −0.42 Hertz.

EXAMPLE 2

This Example describes the same electrolyzer as in Example 1 after 17 days of operation.

An electrolysis is carried out with the use of the electrolyzer described in Example 1 in which aqueous sodium chloride solution served as anolyte and aqueous sodium hydroxide solution as catholyte. On the 17th day of operation of the aforesaid electrolyzer in each of the cell units the catholyte is fed at a rate of about 9.2 gallons per minute [34.8 liters per minute]. In each of the cell units, the anolyte is fed at a rate of about 8.0 gallons per minute [30.3 liters per minute]. Ion exchange treated NaCl brine (about 308 grams/liter NaCl, 1.2 grams per liter $Na_2CO_3$, and about 0.2 grams per liter NaOH) is added to the inlet anolyte line so that a concentration of about 200 grams per liter NaCl is reached at the discharge of the anode chamber for the sodium chloride solution. Water is added to the inlet catholyte line so that a sodium hydroxide concentration of about 32 weight % is obtained at the discharge of the cathode chamber. An electrolysis temperature of about 90° C. is obtained in the cathode and in the anode chambers by using heat exchangers.

Chlorine is formed at the anode and hydrogen at the cathode. There is an automatic pressure control valve at the top of the anolyte tank where the gaseous chlorine product is removed from the system. The chlorine pressure in the anolyte tank is measured using a pressure meter. This automatic valve is used to set the chlorine pressure in the anolyte tank at 5.11 psig (0.36 kilograms per square centimeter. The pressure difference between the cathode and the anode chambers is regulated by the adjustment of the corresponding pressure in the catholyte tank where the pressure difference between the catholyte tank and the anolyte tank is measured with a differential pressure meter. This differential between the catholyte tank and the anolyte tank is maintained at about 12 inches $H_2O$ differential pressure (more in the cathode chamber) using an automatic differential pressure control valve at the top of the catholyte tnak where the gaseous hydrogen product is removed from the system. The pressure in the catholyte tank is measured using a pressure meter and is about 5.3 psig (0.37 kilograms per square centimeter).

The superficial flow velocity near the top of the cathode chamber is about 0.025 ft./sec. (0.46 meters per minute) for the liquid phase, for the gas phase it is about 0.11 ft./sec. (2 meters per minute). Actual velocities in the catholyte chamber may be different from this because the flow inside this chamber is complex and involves internal recirculation of electrolyte. The superficial flow velocity through the area between the front of the two-phase dampening device and the membrane is about about 0.064 ft./sec. (1.17 meters per minute) for the liquid phase and for the gas phase it is about 0.248 ft./sec. (0.45 meters per minute). The flow velocity through the 48 holes in the two-phase dampening device probably varies for each hole because flows through each hole are probably different. For a hole that conducts the average flow (1/48 of the liquid flow from the cell and 1/48 of the gas flow from the cell), the superficial liquid velocity is about 3.1 ft./sec. (56.7 meters per minute). The superficial gas velocity is about 13.6 ft./sec. (249 meters per minute). The flow velocity inside the two-phase dampening device varies across the length of the dampening device because of the flow through the dampening device increases as the flow through each hole adds to it. The maximum velocity of flow through the dampening device would correspond to the total liquid and gas flow out of the cell. The superficial liquid velocity corresponding to this total flow is about 3.9 ft./sec. (71.3 meters per minute). The superficial gas velocity corresponding to this total flow is about 17.3 ft./sec. (316 meters per minute).

The superficial flow velocity near the top of the anode chamber is about 0.028 ft./sec. (0.51 meters per minute) for the liquid phase, for the gas phase it is about 0.19 ft./sec. (3.47 meters per minute). Actual velocities in the anolyte chamber may be different from this because the flow inside this chamber is complex and involves internal recirculation of electrolyte. The superficial flow velocity through the area between the front of the two-phase dampening device and the membrane is about 0.14 ft./sec. (2.56 meters per minute) (for the liquid phase and for the gas phase it is about 0.96 ft./sec. (17.6 meters per minute). The flow velocity through the 48 holes in the two-phase dampening device probably varies for each hole because flows through each hole are probably different. For a hole that conducts the average flow (1/48 of the liquid flow from the cell and 1/48 of the gas flow from the cell), the superficial liquid velocity is 2.7 ft./sec. (49.4 meters per minute) and the superficial gas velocity is 18.1 ft./sec. (331 meters per minute). The flow velocity inside the two-phase dampening device varies across the length of the dampening device because the flow through the dampening device increases as the flow through each hole adds to it. The maximum velocity of flow through the dampening device would correspond to the total liquid and gas flow out of the cell. The superficial liquid velocity corresponding to this total flow is about 3.4 ft./sec. (62.2 meters per minute). The superficial gas velocity corresponding to this total flow is about 23.1 ft./sec. (422 meters per minute).

The caustic current efficiency is measured using a timed weigh tank system. Result is about 96% caustic current efficiency. The method of Example 1 is used to measure cell pressure fluctuation. Results:

Anolyte Compartment average amplitude of pressure fluctuations −8.4 in. $H_2O$ and average frequency of pressure fluctuations −0.51 Hertz Catholyte Compartment average amplitude of pressure fluctuations −12.3 in. $H_2O$ and average frequency of pressure fluctuations −0.55 Hertz.

EXAMPLE 3

This Example describes the same electrolyzer as in Example 1 and gives data after 54 days of operation, at 5 pounds per square inch pressure.

An electrolysis is carried out with the use of the electrolyzer described in Example 1 in which aqueous sodium chloride solution serves as anolyte and aqueous sodium hydroxide solution as catholyte. On the 54th day of operation of the aforesaid electrolyzer in each of the cell units the catholyte is fed at a rate of about 8.0 gallons per minute (30.3 liters per minute). In each of the cell units, the anolyte is fed at a rate of about 7.8 gallons per minute (29.5 liters per minute). Ion exchange treated NaCl brine (about 303 grams/liter NaCl, about 0.8 gal $Na_2CO_3$, about 0.2 grams per liter NaOH) is added to the inlet anolyte line so that a concentration of about 200 grams per liter NaCl is reached at the discharge of the anode chamber for the sodium chloride solution. Water is added to the inlet catholyte line so that a sodium hydroxide concentration of about 32 weight % is obtained atht discharge of the cathode chamber. An electrolysis temperature of about 91° C. is obtained in the cathode and in the anode chambers by using heat exchangers.

Chlorine is formed at the anode and hydrogen at the cathode. There is an automatic pressure control valve at the top of the anolyte tank where the gaseous chlorine product is removed from the system. The chlorine pressure in the anolyte tank is measured using a pressure meter. This automatic valve is used to set the chlorine pressure in the anolyte tank at about 5 psig (0.35 kilograms per square centimeter). The pressure difference between the cathode and the anode chambers is regulated by the adjustment of the corresponding pressure in the catholyte tank where the pressure difference between the catholyte tank and the anolyte tank is measured with a differential pressure meter. This differential between the catholyte tank and the anolyte tank is maintained at about 19 inches $H_2O$ differential pressure (more in the cathode chamber) using an automatic differential pressure control valve at the top of the catholyte tank where the gaseous hydrogen product is removed from the system. The pressure in the catholyte tank is measured using a pressure meter and is about 5 psig (0.35 kilograms per square centimeter).

The superficial flow velocity near the top of the cathode chamber is about 0.022 ft/sec. (0.4 meters per minute) for the liquid phase, for the gas phase it is about 0.11 ft/sec. (2 meters per minute). Actual velocities in the catholyte chamber may be different from this because the flow inside this chamber is complex and involves internal recirculation of electrolyte. The superficial flow velocity through the area between the front of the two-phase dampening device and the membrane is about 0.055 ft./sec. (1 meter per minute) for the liquid phase and for the gas phase it is about 0.29 ft./sec. (5.3 meters per minute). The flow velocity through the 48 holes in the two-phase dampening device probably varies for each hole because flows through each hole are probably varies for each hole because flows through each hole are probably different. For a hole that conducts the average flow (1/48 of the liquid flow from the cell and 1/48 of the gas flow from the cell, the superficial liquid velocity is about 2.7 ft./sec. (49.4 meters per minute) The superficial gas velocity is about 13.9 ft./sec. (62.2 meters per minute). The flow velocity inside the two-phase dampening device various across the length of the dampening device because the flow through the dampening device increases as the flow through each hole adds to it. The maximum velocity of flow through the dampening device would correspond to the total liquid and gas flow out of the cell. The superficial liquid velocity corresponding to this total flow is about 3.4 ft./sec. (62.2 meters per minute). The superficial gas velocity corresponding to this total flow is about 17.1 ft./sec. (324 meters per minute).

The superficial flow velocity near the top of the anode chamber is about 0.027 ft./sec. (0.49 meters per minute) for the liquid phase, for the gas phase it is about 0.20 ft./sec. (3.66 meters per minute). Actual velocities in the anolyte chamber may be different from this because the flow inside this chamber is complex and involves internal recirculation of electrolyte. The superficial flow velocity through the area between the front of the two-phase dampening device and the membrane is about 0.14 ft./sec. (2.56 meters per minute) for the liquid phase and for the gas phase it is about 1.0 ft./sec. (18.3 meters per minute). The flow velocity through the 48 holes in the two-phase dampening device probably varies for each hole because flows through each hole are probably different. For a hole that conducts the average flow (1/48 of the liquid flow from the cell and 1/48 of the gas flow from the cell), the superficial liquid velocity is about 2.6 ft./sec. (47.5 meters per minute) and the superficial gas velocity is about 18.9 ft./sec. (346 meters per minute). The flow velocity inside the two-phase dampening device varies across the length of the dampening device because the flow through the dampening device increases as the flow through each hole adds to it. The maximum velocity of flow through the dampening device could correspond to the total liquid and gas flow out of the cell. The superficial liquid velocity corresponding to this total flow is about 3.3 ft./sec. (60.4 meters per minute). The superficial gas velocity corresponding to this total flow is about 24.1 ft./sec. (440 meters per minute).

The method of Example 1 is used to measure caustic current efficiency. Results show about 95.9% caustic current efficiency.

EXAMPLE 4

This Example describes the cell of Example 1 after 59 days of operation at 15 pounds per square inch pressure.

An electrolysis is carried out with the use of the electrolyzer described in Example 1 in which aqueous sodium chloride solution serves as anolyte and aqueous sodium hydroxide solution as catholyte. On the 59th day of operation of the aforesaid electrolyzer in each of the cell units the catholyte is fed at a rate of about 7.9 gallons per minute (29.9 liters per minute). In each of the cell units, the anolyte is fed at a rate of about 8.0 gallons per minute (30.3 liters per minute). Ion exchange treated NaCl brine (about 300 grams/liter NaCl, about 0.8 grams per liter $Na_2CO_3$, and about 0.2 grams per liter NaOH) is added to the inlet anolyte line so that a concentration of 200 grams per liter NaCl is reached at the discharge of the anode chamber for the sodium chloride solution. Water is added to the inlet catholyte line so that a sodium hydroxide concentration of about 32 weight % is obtained at the discharge of the cathode chamber. An electrolysis temperature of about 88° C. is obtained in the cathode and in the anode chambers by using heat exchangers.

Chlorine is formed at the anode and hydrogen at the cathode. There is an automatic pressure control valve at the top of the anolyte tank where the gaseous chlorine product is removed from the system. The chlorine pressure in the anolyte tank is measured using a pressure meter. This automatic valve is used to set the chlorine pressure in the anolyte tank at about 14.6 psig (1.03 kilograms per square centimeter). The pressure difference between the cathode and the anode chambers is regulated by the adjustment of the corresponding pressure in the catholyte tank where the pressure difference between the catholyte tank and the anolyte tank is measured with a differential pressure meter. This differential between the catholyte tank and the anolyte tank is maintained at about 19 inches $H_2O$ differential pressure (more in the cathode chamber) using an automatic differential pressure control valve at the top of the catholyte tank where the gaseous hydrogen product is removed from the system. The pressure in the catholyte tank is measured using a pressure meter and is about 14.8 psig (1.04 kilograms per square centimeter).

The superficial flow velocity near the top of the cathode chamber is about 0.021 ft/sec. (0.38 meter per minute) for the liquid phase, for the gas phase it is about 0.082 ft./sec. (1.5 meters per minute). The superficial flow velocity through the area between the front of the two-phase dampening device and the membrane is about 0.055 ft/sec. (1 meter per minute) for the liquid phase and for the gas phase it is about 0.21 ft./sec. (3.8 meters per minute). The flow velocity through the 48 holes in the two-phase dampening device probably varies for each hole because flows through each hole are probably varies for each hole because flows through each hole are probably different. For a hole that conducts the average flow (1/48 of the liquid flow from the cell and 1/48 of the gas flow from the cell, the superficial liquid velocity is about 2.6 ft./sec. (47.5 meters per minute). The superficial gas velocity is about 10 ft./sec. (183 meters per minute). The flow velocity inside the two-phase dampening device varies across the length of the dampening device because the flow through the dampening device increases as the flow through each hole adds to it. The maximum velocity of flow through the dampening device would correspond to the total liquid and gas flow out of the cell. The superficial liquid velocity corresponding to this total flow is about 3.3 ft./sec. (60.4 meters per minute). The superficial gas velocity corresponding to this total flow is about 12.8 ft./sec. (234 meters per minute).

The superficial flow velocity near the top of the anode chamber is about 0.028 ft./sec. (0.51 meter per minute) for the liquid phase, for the gas phase it is about 0.12 ft./sec. (2.19 meters per minute). Actual velocities in the anolyte chamber may be different from this because the flow inside this chamber is complex and involves internal recirculation of electrolyte. The superficial flow velocity through the area between the front of the two-phase dampening device and the membrane is about 0.14 ft./sec. (2.56 meters per minute) for the liquid phase and for the gas phase it is about 0.62 ft./sec. (11.3 meters per minute). The flow velocity through the 48 holes in the two-phase dampening device probably varies for each hole because flows through each hole are probably different. For a hole that conducts the average flow (1/48 of the liquid flow from the cell and 1/48 of the gas flow from the cell), the superficial liquid velocity is about 2.7 ft./sec. (49.4 meters per minute) and the superficial gas velocity is about 11.7 ft./sec. (214 meters per minute). The flow velocity inside the two-phase dampening device varies across the length of the dampening device because the flow through the dampening device increases as the flow through each hole adds to it. The maximum velocity of flow through the dampening device would correspond to the total liquid and gas flow out of the cell. The superficial liquid velocity corresponding to this total flow is about 3.4 ft./sec. (62.2 meters per minute). The superficial gas velocity corresponding to this total flow is about 14.9 ft./sec. (272 meters per minute).

Pressure pulse measurements are made in the same way as in Example 1. Results:

Anolyte Compartment: Average amplitude of pressure pulse −10.0 in. $H_2O$ Average frequency of pressure pulse −0.56 Hertz Catholyte Compartment: Average amplitude of pressure pulse −9.6 in. $H_2O$ Average frequency of pressure pulse −1.17 Hertz.

EXAMPLE 5

This Example shows the operation of the cell of Example 1 in operation at 59 days at a pressure of 15 pounds per square inch pressure and a high recycle rates.

An electrolysis is carried out with the use of the electrolyzer described in Example 1 in which aqueous sodium chloride solution serves as anolyte and aqueous sodium hydroxide solution as catholyte. On the 59th day of operation of the aforesaid electrolyzer in each of the cell units the catholyte is fed at a rate of about 10.0 gallons per minute (37.9 liters per minute). In each of the cell units, the anolyte is fed at a rate of about 10.1 gallons per minute (38.2 liters per minute). Ion exchange treated NaCl brine (about 300 grams/liter NaCl, about 0.8 grams per liter $Na_2CO_3$, and about 0.2 grams per liter NaOH) is added to the inlet anolyte line so that a concentration of about 200 grams per liter NaCl is reached at the discharge of the anode chamber for the sodium chloride solution. Water is added to the inlet catholyte line so that a sodium hydroxide concentration of about 32 weight % is obtained at the discharge of the cathode chamber. An electrolysis temperature of about 89° C. is obtained in the cathode and in the anode chambers by using the aforementioned heat exchangers.

Chlorine is formed at the anode and hydrogen at the cathode. There is an automatic pressure control valve at the top of the anolyte tank where the gaseous chlorine product is removed from the system. The chlorine pressure in the anolyte tank is measured using a pressure meter. This automatic valve is used to set the chlorine pressure in the anolyte tank at about 14.6 psig (1.03 kilograms per square centimeter). The pressure difference between the cathode and the anode chambers is regulated by the adjustment of the corresponding pressure in the catholyte tank where the pressure difference between the catholyte tank and the anolyte tank is measured with a differential pressure meter. This differential between the catholyte tank and the anolyte tank is maintained at about 19 inches $H_2O$ differential pressure (more in the cathode chamber) using an automatic differential pressure control valve at the top of the catholyte tank where the gaseous hydrogen product is removed from the system. The pressure in the catholyte tank is measured using a pressure meter and is about 14.8 psig (1.04 kilograms per square centimeter).

The superficial flow velocity near the top of the cathode chamber is about 0.027 ft/sec. (0.49 meter per minute) for the liquid phase, for the gas phase it is about 0.050 ft/sec. (0.91 meter per minute). Actual velocities in the catholyte chamber may be different from this because the flow inside this chamber is complex and involves internal recirculation of electrolyte. The superficial flow velocity through the area between the front of the two-phase dampening device and the membrane is about 0.070 ft./sec. (1.28 meters per minute) for the liquid phase and for the gas phase it is about 0.13 ft./sec. (2.38 meters per minute). The flow velocity through the 48 holes in the two-phase dampening device probably varies for each hole because flows through each hole are probably varies for each hole because flows through each hole are probably different. For a hole that conducts the average flow (1/48 of the liquid flow from the cell and 1/48 of the gas flow from the cell, the superficial liquid velocity is about 3.3 ft./sec. (60.4 meters per minute). The superficial gas velocity is about 6.1 ft./sec. (112 meters per minute). The flow velocity inside the two-phase dampening device varies across the length of the dampening device because the flow through the dampening device increases as the flow through each hole adds to it. The maximum velocity of flow through the dampening device would correspond to the total liquid and gas flow out of the cell. The superficial liquid velocity corresponding to this total flow is about 4.2 ft./sec. (77 meters per minute). The superficial gas velocity corresponding to this total flow is about 7.8 ft./sec. (143 meters per minute).

The superficial flow velocity near the top of the anode chamber is about 0.035 ft/sec. (0.64 meter per minute) for the liquid phase, for the gas phase it is about 0.075 ft./sec. (1.37 meters per minute). Actual velocities in the anolyte chamber may be different from this because the flow inside this chamber is complex and involves internal recirculation of electrolyte. The superficial flow velocity through the area between the front of the two-phase dampening device and the membrane is about 0.18 ft./sec. (3.3 meters per minute) for the liquid phase and for the gas phase it is about 0.38 ft./sec. (7.0 meters per minute). The flow velocity through the 48 holes in the two-phase dampening device probably varies for each hole because flows through each hole are probably different. For a hole that conducts the average flow (1/48 of the liquid flow from the cell and 1/48 of the gas flow from the cell), the superficial liquid velocity is about 3.4 ft/sec. (62 meters per minute) and the superficial gas velocity is about 7.2 ft./sec. (131 meters per minute). The flow velocity inside the two-phase dampening device varies across the length of the dampening device because the flow through the dampening device increases as the flow through each hole adds to it. The maximim velocity of flow through the dampening device would correspond to the total liquid and gas flow out of the cell. The superficial liquid velocity corresponding to this total flow is about 4.3 ft./sec. (14 meters per minute). The superficial gas velocity corresponding to this total flow is about 9.1 ft./sec. (166 meters per minute).

The cell is disassembled and the membrane is inspected for wear. It is found to be almost completely free of wear.

Pressure pulse measurements are made in the same way as in Example 1. Results:

Anolyte Compartment: Average amplitude of pressure pulse −7.0 in. $H_2O$. Average frequency of pressure pulse −0.89 Hertz.

Catholyte Compartment: Average amplitude of pressure pulse −6.6 in. $H_2O$. Average frequency of pressure pulse −0.76 Hertz.

We claim:

1. A dampening device for use in a vertically disposed electrochemical cell unit of the type at least having:

(a) a peripheral flange which defines at least one electrode chamber, said peripheral flange having a upper, substantially horizontally disposed flange portion, a lower substantially horizontally disposed flange portion, and two disposed side flange portions; and (b) at least one outlet port passing through the upper horizontally disposed flange portion or through one of the two vertical side flange portions or through the lower flange portions and connecting the exterior of the cell with the electrode chamber, said dampening device comprising:

an elongated, hollow dampening device positioned across at least a portion of the top of the electrode chamber adjacent to the upper, horizontally disposed flange portion, said dampening device being in fluid flow communication with said electrode chamber and with said outlet port(s), wherein the dampening device has at least one opening near its top which connects the interior of the dampening device with the electrode chamber, wherein said opening(s) has a total cross sectional area less than or equal to the greatest internal cross sectional area of the dampening device, wherein the size and shape of said dampening device is adapted to cause an increase in flow velocity of any fluid passing from the electrode chamber into the opening(s) in the dampening device.

2. The dampening device of claim 1 wherein the dampening device has an upper surface approximately corresponding to the shape of the upper, internal edge of the peripheral flange portion.

3. The dampening device of claim 1 wherein the dampening device has both of its ends open to the electrode chamber.

4. The dampening device of claim 1 wherein the dampening device has one of its ends open to the electrode chamber.

5. The dampening device of claim 1 wherein the dampening device has neither of its ends open to the electrode chamber.

6. The dampening device of claim 1 wherein the dampening device is spaced apart from the upper, internal edge of the peripheral flange portion.

7. The dampening device of claim 1 wherein the dampening device is in contact with the upper, internal edge of the peripheral flange portion.

8. The dampening device of claim 1 wherein the dampening device is substantially hollow.

9. A dampening device for use in a vertically disposed electrochemical cell unit of the type at least having:

(a) a peripheral flange which defines at least one electrode chamber, said peripheral flange having a upper, substantially horizontally disposed flange portion, a lower substantially horizontally disposed flange portion, and two disposed side flange portions; and (b) at least one outlet port passing through the upper horizontally disposed flange portion or through one of the two vertical said flange portions or through the lower flange portion and connecting the exterior of the cell with the electrode chamber, said dampening device comprising:

an elongated, hollow dampening device at least partially filled with a packing material and positioned across at least a portion of the top of the electrode chamber adjacent to the upper, horizontally disposed flange portion, said dampening device being in fluid flow communication with said electrode chamber and with said outlet port(s), wherein the dampening device has at least one opening near its top which connects the interior of the dampening device with the electrode chamber, wherein said opening(s) has a total cross sectional area less than or equal to the greatest internal cross sectional area of the dampening device.

10. The dampening device of claim 9 wherein the dampeing device has flow direction controlling devices.

11. The dampening device of claim 10 wherein the dampening device has channels or vanes attached to its interior surface to act as flow direction controlling devices.

12. The dampening device of claim 9 wherein the walls of the dampening device are at least partially defined by the peripheral flange portion.

13. The dampening device of claim 9 wherein the walls of the dampening device are at least partially defined by a cell planar backboard.

14. The dampening device of claim 1 wherein the dampening device extends across the top of the electrode chamber over at least 50 percent of the distance of the electrode chamber.

15. The dampeing device of claim 1 wherein the dampening device extends substantially 100 percent of the distance across the top of the electrode chamber.

16. The dampening device of claim 1 wherein the dampening device is substantially parallel to the upper, internal edge of the peripheral flange portion.

17. The dampening device of claim 1 wherein the dampening device slants toward the outlet port.

18. The dampening device of claim 1 wherein the dampening device has an opening at least one slit.

19. The dampening device of claim 1 wherein the dampening device has an opening a plurality of slits.

20. The dampening device of claim 1 wherein the dampening device has an opening a plurality of holes.

21. The dampening device of claim 20 wherein the holes are substantially evenly spaced throughout the length of the duct.

22. The dampening device of claim 20 wherein the holes each have a cross-sectional area of from about 0.2 square millimeters to about 200 square millimeters.

23. The dampening device of claim 20 wherein the holes each have a cross-sectional area of from about 3 square millimeters to about 50 square millimeters.

24. The dampening device of claim 20 wherein the holes each have a cross-sectional area of from about 7 square millimeters to about 20 square millimeters.

25. The dampening device of claim 1 wherein the dampening device is generally cylindrically shaped.

26. The dampening device of claim 1 wherein the dampening device has a cross-sectional area that is generally rectangularly shaped.

27. An electrochemical cell comprising:

(a) a peripheral flange which defines at least one electrode chamber, said peripheral flange having a upper, substantially horizontally disposed flange portion, a lower substantially horizontally disposed flange portion, and two disposed side flange portions;

(b) at least one outlet port passing through the upper horizontally disposed flange portion or through one of the two vertical side flange portions or through the lower flange portion and connecting the exterior of the cell with the electrode chamber; and (c) an elongated, hollow duct positioned across at least a portion of the top of the electrode chamber adjacent to the upper, horizontally disposed flange portion, said duct being in fluid flow communication with said electrode chamber and with said outlet port(s), wherein the duct has at least one opening near its top which connects the interior of the duct with the electrode chamber, wherein said opening(s) has a total cross sectional area less than or equal to the greatest internal cross sectional area of the duct, wherein the size and shape of said dampening device is adapted to cause an increase in flow velocity of any fluid passing from the electrode chamber into the opening(s) in the dampening device.

28. The electrochemical cell of claim 27 wherein the electrochemical cellunit is substantially planar.

29. The electrochemical cell of claim 28 wherein the substantially planar electrochemical cell unit has a generally rectangular shape.

30. The electrochemical cell of claim 29 wherein the electrochemical cell unit has one outlet port for each electrode chamber.

31. The electrochemical cell of claim 30 wherein the outlet port is located near a corner of the generally rectangular electrochemical cell unit.

32. The electrochemical cell of claim 29 wherein the dampening device is substantially parallel to the upper, internal edge of the peripheral flange portion.

33. The electrochemical cell of claim 27 wherein the electrochemical cell unit has more than one outlet port per electrode chamber.

34. The electrochemical cell of claim 27 wherein the dampening device has an upper surface approximately corresponding to the shape of the upper, internal edge of the peripheral flange portion.

35. The electrochemical cell of claim 27 wherein the upper, internal edge of the peripheral flange portion is substantially planar.

36. The electrochemical cell of claim 27 wherein the dampening device has both of its ends open to the electrode chamber.

37. The electrochemical cell of claim 27 wherein the dampening device has one of its ends open to the electrode chamber.

38. The electrochemical cell of claim 27 wherein the dampening device has neither of its ends open to the electrode chamber.

39. The electrochemical cell of claim 27 wherein the dampening device is spaced apart from the upper, internal edge of the peripheral flange portion.

40. The electrochemical cell of claim 27 wherein the dampening device is in contact with the upper, internal edge of the peripheral flange portion.

41. The electrochemical cell of claim 27 wherein the dampening device is spaced apart from the electrode.

42. The electrochemical cell of claim 27 wherein the dampening device is substantially hollow.

43. The electrochemical cell of claim 27 wherein the dampening device extends across the top of the electrode chamber over at least 50 percent of the distance of the electrode chamber.

44. The electrochemical cell of claim 27 wherein the dampening device extends substantially 100 percent of the distance across the top of the electrode chamber.

45. The electrochemical cell of claim 27 wherein the dampening device slants towards the outlet port.

46. The electrochemical cell of claim 27 wherein the dampening device has as an opening at least one slit.

47. The electrochemical cell of claim 27 wherein the dampening device has as an opening a plurality of slits.

48. The electrochemical cell of claim 27 wherein the dampening device has as an opening a plurality of holes.

49. The electrochemical cell of claim 48 wherein the holes are substantially evenly spaced throughout the length of the duct.

50. The electrochemical cell of claim 48 wherein the holes each have a cross-sectional area of from about 0.2 square millimeters to about 200 square millimeters.

51. The electrochemical cell of claim 48 wherein the holes each have a cross-sectional area of from about 3 square millimeters to about 50 square millimeters.

52. The electrochemical cell of claim 48 wherein the holes each have a cross-sectional area of from about 7 square millimeters to about 20 square millimeters.

53. The electrochemical cell of claim 27 wherein the dampening device is generally cylindrically shaped.

54. The electrochemical cell of claim 27 wherein the dampening device has a cross-sectional area that is generally rectangularly shaped.

55. An electrochemical cell comprising:

(a) a peripheral flange which defines at least one electrode chamber, said peripheral flange having a upper, substantially horizontally disposed flange portion, a lower substantially horizontally disposed flange portion, and two disposed side flange portions;

(b) at least one outlet port passing through the upper horizontally disposed flange portion or through one of the two vertical side flange portions or through the lower flange portion and connecting the exterior of the cell with the electrode chamber; and (c) an elongated, hollow duct at least partially filled with a packing material and positioned across at least a portion of the top of the electrode chamber adjacent to the upper, horizontally disposed flange portion, said duct being in fluid flow communication with said electrode chamber and with said outlet port(s), wherein the duct has at least one opening near its top which connects the interior of the duct with the electrode chamber, wherein said opening(s) has a total cross sectional area less than or equal to the greatest internal cross sectional area of the duct.

56. The electrochemical cell of claim 35 wherein the dampening device has flow direction controlling devices.

57. The electrochemical cell of claim 35 wherein the dampening device has channels or vanes attached to its interior surface to act as flow direction controlling devices.

58. The electrochemical cell of claim 35 wherein the walls of the dampening device are at least partially defined by the peripheral flange portion.

59. The electrochemical cell of claim 35 wherein the walls of the dampening device are at least partially defined by a cell planar backboard.

* * * * *